US006095710A

United States Patent [19]

Ayeni

[11] Patent Number: 6,095,710

[45] Date of Patent: Aug. 1, 2000

[54] TOOTHPASTE DISPENSING TOOTHBRUSH WITH VALVE

[76] Inventor: Joseph Ayeni, 48 Chadworth House, Amwell Court, Greenlanes, London N4 2PB, United Kingdom

[21] Appl. No.: 09/116,967

[22] Filed: Jul. 16, 1998

[51] Int. Cl.[7] ..... A46B 11/04

[52] U.S. Cl. ..... 401/270; 401/278

[58] Field of Search ..... 401/270, 268, 401/274, 278, 279

[56] References Cited

U.S. PATENT DOCUMENTS 4,201,490 5/1980 D'Angelo ..... 401/270

4,615,635 10/1986 Kim ..... 401/270

5,599,126 2/1997 Hough ..... 401/268

*Primary Examiner*—David J. Walczak

[57] ABSTRACT

A toothpaste dispensing toothbrush includes a housing for storing toothpaste therein. Also included is a hollow brush assembly coupled to the housing. A plurality of bristles extend from the brush assembly. Further, at least one opening is formed in the brush assembly which is in communication with the housing. A valve is mounted on the brush assembly for selectively allowing the passage of the toothpaste through the opening.

19 Claims, 2 Drawing Sheets

TOOTHPASTE DISPENSING TOOTHBRUSH WITH VALVE

BACKGROUND OF THE INVENTION

1. Field of the Invention

The present invention relates to toothbrushes and more particularly pertains to a new toothpaste dispensing toothbrush with valve for conveniently dispensing toothpaste from a toothbrush.

2. Description of the Prior Art

The use of toothbrushes is known in the prior art. More specifically, toothbrushes heretofore devised and utilized are known to consist basically of familiar, expected and obvious structural configurations, notwithstanding the myriad of designs encompassed by the crowded prior art which have been developed for the fulfillment of countless objectives and requirements.

Known prior art toothbrushes include U.S. Pat. No. 4,717,278; U.S. Pat. No. 4,062,635; U.S. Pat. No. 4,039,261; U.S. Pat. No. 4,155,663; U.S. Pat. Des. No. 336,782; and U.S. Pat. No. 4,821,752.

In these respects, the toothpaste dispensing toothbrush with valve according to the present invention substantially departs from the conventional concepts and designs of the prior art, and in so doing provides an apparatus primarily developed for the purpose of conveniently dispensing toothpaste from a toothbrush.

SUMMARY OF THE INVENTION

In view of the foregoing disadvantages inherent in the known types of toothbrushes now present in the prior art, the present invention provides a new toothpaste dispensing toothbrush with valve construction wherein the same can be utilized for conveniently dispensing toothpaste from a toothbrush.

The general purpose of the present invention, which will be described subsequently in greater detail, is to provide a new toothpaste dispensing toothbrush with valve apparatus and method which has many of the advantages of the toothbrushes mentioned heretofore and many novel features that result in a new toothpaste dispensing toothbrush with valve which is not anticipated, rendered obvious, suggested, or even implied by any of the prior art toothbrushes, either alone or in any combination thereof.

To attain this, the present invention generally comprises a housing with a cylindrical configuration. As shown in the Figures, the housing includes a circular bottom face and a cylindrical peripheral side wall coupled to the bottom face and extending upwardly therefrom. A top face of the housing has a tapered bottom portion and a tubular top portion including a diameter less than that of the side wall. A plurality of threaded grooves are formed in an outer surface of the housing. Further, a foil membrane is sealed over the top portion of the housing. In use, toothpaste is stored in the housing. FIGS. 2, 3 & 6 depict a cap with a cylindrical configuration. The cap includes a pair of open ends having threaded grooves formed in an interior surface thereof. A divider is formed in a central extent of the cap with a planar first side face and a conical second side face. By this structure, the cap is coupleable on the tubular top portion of the housing with the first side face abutting the top portion of the housing for storage purposes. The cap is further coupleable to the housing such that the second side face abuts the foil membrane for piercing the same. Next provided is a hollow brush assembly including an inboard extent with a cylindrical configuration. Such inboard extent has a diameter equal to that of the top portion of the housing. The brush assembly further has an outboard extent with a rectangular configuration. For reasons that will soon become apparent, the brush assembly is constructed from a flexible material. A bottom face of the outboard extent has a matrix of tight bundles of bristles coupled thereto and extending therefrom. The bottom face further has a pair of longitudinally disposed parallel columns of linearly aligned apertures. As shown in FIG. 4, the inboard extent has a plurality of threaded grooves formed therein for removably coupling with those of the housing. Also provided is a valve mechanism including a pair of resilient tabs integrally coupled within an interior space of the outboard extent of the brush assembly. It should be noted that the tabs extend longitudinally between a front and a rear face of the outboard extent of the brush assembly. Each tab has a post coupled thereto and extending laterally for coupling with an interior surface of a side face of the outboard extent of the brush assembly. As shown in FIGS. 5A & 5B, the tabs have an unbiased orientation situated over an associated one of the columns of apertures of the brush assembly. In this orientation, the tabs are adapted for precluding a flow of toothpaste through the apertures. The tabs further have a biased orientation upon the depression of the side faces of the outboard extent of the brush assembly. In the biased orientation, the tabs are adapted for exposing the corresponding apertures of the brush assembly thus allowing toothpaste to be dispensed therethrough. Finally, a cover is provided which is constructed from a transparent plastic material. The cover includes a circular top face and a cylindrical peripheral side wall integrally coupled to the top face and extending therefrom. As such, an open bottom is designed for releasably receiving the top portion of the housing thereby selectively covering the brush assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toothpaste dispensing toothbrush with valve apparatus and method which has many of the advantages of the toothbrushes mentioned heretofore and many novel features that result in a new toothpaste dispensing toothbrush with valve which is not anticipated, rendered obvious, suggested, or even implied by any of the prior art toothbrushes, either alone or in any combination thereof.

It is another object of the present invention to provide a new toothpaste dispensing toothbrush with valve which may be easily and efficiently manufactured and marketed.

It is a further object of the present invention to provide a new toothpaste dispensing toothbrush with valve which is of a durable and reliable construction.

An even further object of the present invention is to provide a new toothpaste dispensing toothbrush with valve which is susceptible of a low cost of manufacture with regard to both materials and labor, and which accordingly is then susceptible of low prices of sale to the consuming public, thereby making such toothpaste dispensing toothbrush with valve economically available to the buying public.

Still yet another object of the present invention is to provide a new toothpaste dispensing toothbrush with valve which provides in the apparatuses and methods of the prior art some of the advantages thereof, while simultaneously overcoming some of the disadvantages normally associated therewith.

Still another object of the present invention is to provide a new toothpaste dispensing toothbrush with valve for conveniently dispensing toothpaste from a toothbrush.

Even still another object of the present invention is to provide a new toothpaste dispensing toothbrush with valve that includes a housing for storing toothpaste therein. Also included is a hollow brush assembly coupled to the housing. A plurality of bristles extend from the brush assembly. Further, at least one opening is formed in the brush assembly which is in communication with the housing. A valve is mounted on the brush assembly for selectively allowing the passage of the toothpaste through the opening.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
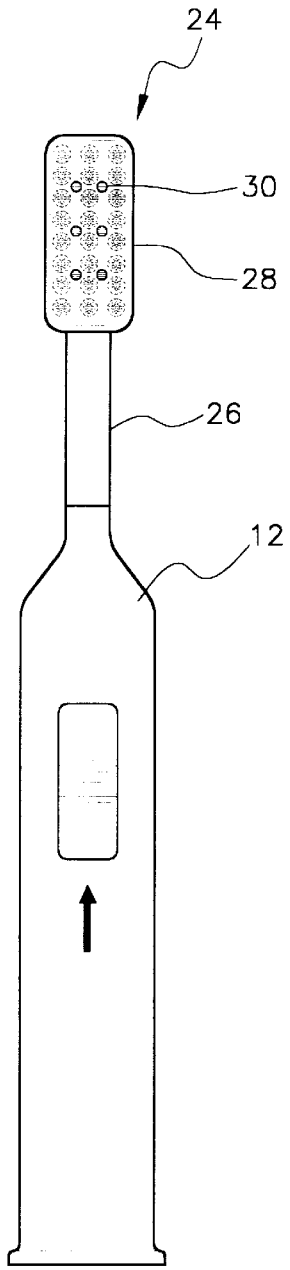
FIG. 1 is a front view of a new toothpaste dispensing toothbrush with valve according to the present invention.

With reference now to the drawings, and in particular to FIGS. 1 through 8D thereof, a new toothpaste dispensing toothbrush with valve embodying the principles and concepts of the present invention and generally designated by the reference numeral 10 will be described.

The present invention, includes a housing 12 with a cylindrical configuration. As shown in the Figures, the housing includes a circular bottom face and a cylindrical peripheral side wall coupled to the bottom face and extending upwardly therefrom. A top face of the housing has a tapered bottom portion and a tubular top portion including a diameter less than that of the side wall. A plurality of threaded grooves 14 are formed in an outer surface of the top portion. Further, a foil membrane 16 is sealed over the top portion for containing toothpaste stored in the housing. As an option, a slider may be positioned on the housing for forcing the toothpaste from the top portion. While not shown, the slider is connected to a tapered block or similar type structure within the housing.

Figure 2:
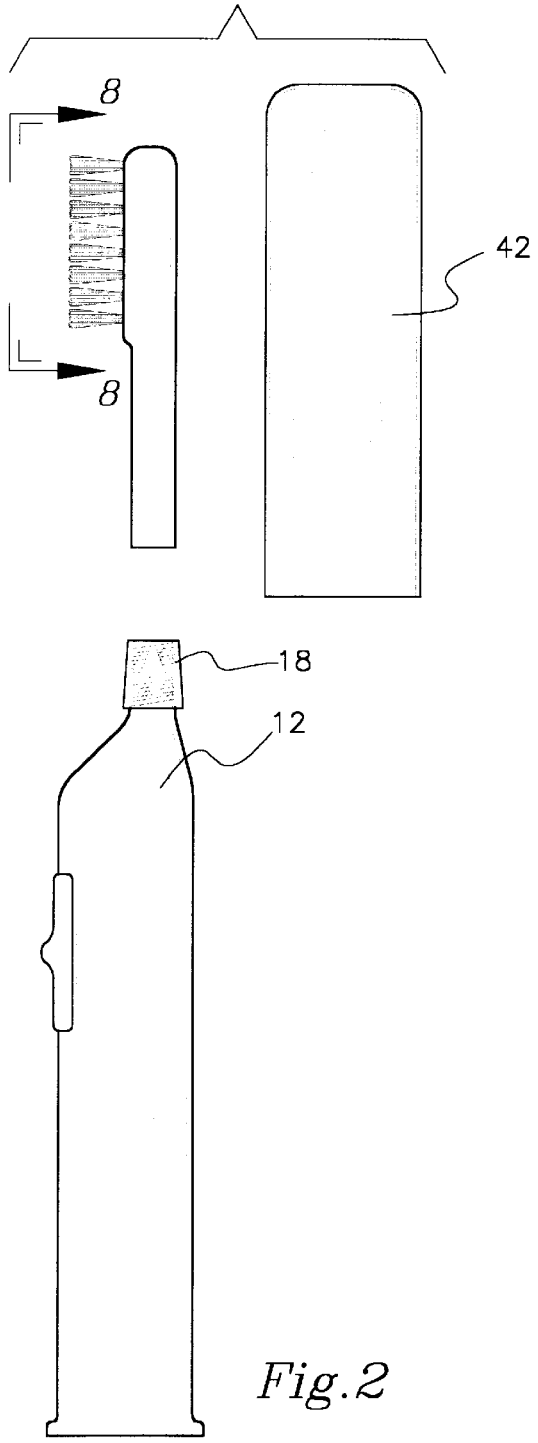
FIG. 2 is a side exploded view of the present invention.
Figures 3, 4, 5A, 5B, 6, 7, 8A, 8B, 8C, 8D:
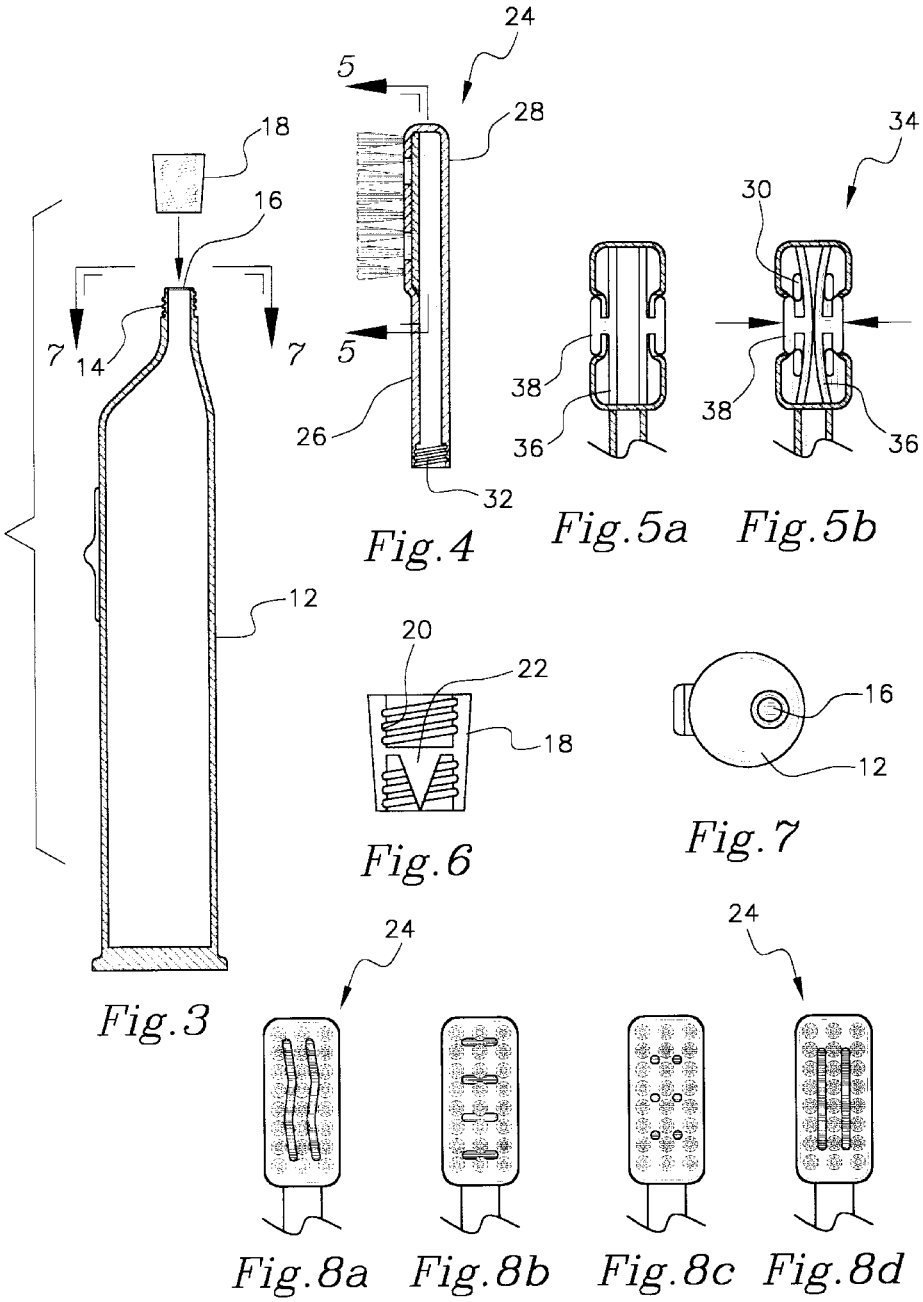
FIG. 3 is an exploded cross-sectional view of the present invention.
FIG. 4 is a cross-sectional view of the brush assembly of the present invention.
FIGS. 5A & 5B are cross-sectional views of the outboard extent of the present invention taken along line 5—5.
FIG. 6 is a cross-sectional view of the cap of the present invention.
FIG. 7 is a top view of the housing of the present invention.
FIGS. 8A–8D show a plurality of alternate designs of toothpaste outlets of the present invention.

FIGS. 2, 3 & 6 depict a cap with a cylindrical configuration. The cap 18 includes a pair of open ends having threaded grooves 20 formed in an interior surface thereof. A divider 22 is formed in a central extent of the cap with a planar first side face and a conical second side face. By this structure, the cap is coupleable to the tubular top portion of the housing with the first side face abutting the top portion of the housing for storage purposes. The cap is further coupleable to the housing such that the second side face abuts the foil membrane for piercing the same.

Next provided is a hollow brush assembly 24 including an inboard extent 26 with a cylindrical configuration. Such inboard extent has a diameter equal to that of the top portion of the housing. The brush assembly further has an outboard extent 28 with a rectangular configuration. For reasons that will soon become apparent, the brush assembly is constructed from a resilient, deformable elastomeric material. A bottom face of the outboard extent has a matrix of tight bundles of bristles coupled thereto and extending therefrom. The bottom face further has a pair of longitudinally disposed parallel columns of linearly aligned apertures 30. As shown in FIGS. 8A–8D, various other types of openings may be formed in the bottom face of the brush assembly in lieu of the apertures. For example, a jagged groove, short lateral slits or elongated longitudinal slits may be employed. As shown in FIG. 4, the inboard extent of the brush assembly has a plurality of threaded grooves 32 formed therein for removably coupling with those of the housing.

Also provided is a valve mechanism 34 including a pair of resilient tabs 36 integrally coupled within an interior space of the outboard extent of the brush assembly. It should be noted that the tabs extend longitudinally between a front and a rear face of the outboard extent of the brush assembly. Further, the tabs slidably abut an interior surface of the bottom face of the brush assembly. Each tab has a post 38 coupled thereto and extending laterally for coupling with an interior surface of a side face of the outboard extent of the brush assembly.

As shown in FIGS. 5A & 5B, the tabs have an unbiased orientation situated over an associated one of the columns of apertures of the brush assembly. In this orientation, the tabs preclude a flow of toothpaste through the apertures. The tabs further have a biased orientation upon the depression of the side faces of the outboard extent of the brush assembly. In the biased orientation, the tabs are adapted for exposing the corresponding apertures of the brush assembly thus allowing toothpaste to be dispensed therethrough. In operation, the valve works to prevent the waste of toothpaste and further precludes the same from clogging the apertures.

Finally, a cover 42 is provided which is constructed from a transparent plastic material. The cover includes a circular top face and a cylindrical peripheral side wall integrally coupled to the top face and extending therefrom. As such, an open bottom is designed for releasably receiving the top portion of the housing thereby selectively covering the brush assembly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toothpaste dispensing toothbrush comprising, in combination:

a housing with a cylindrical configuration including a circular bottom face, a cylindrical peripheral side wall coupled to the bottom face and extending upwardly therefrom, and a top face having a tapered bottom portion and a tubular top portion including a diameter less than that of the side wall, a plurality of threaded grooves formed in an outer surface thereof, and a foil membrane formed thereon, wherein toothpaste is stored in the housing;

a cap with a cylindrical configuration including a pair of open ends having threaded grooves formed in an interior surface thereof and a divider formed in a central extent of the cap with a planar first side face and a conical second side face, whereby the cap is coupleable on the tubular top portion of the housing with the first side face abutting the top portion of the housing for storage purposes and further coupleable such that the second side face abuts the foil membrane for piercing the same;

a hollow brush assembly including an inboard extent with a cylindrical configuration having a diameter equal to that of the top portion of the housing and an outboard extent with a rectangular configuration and constructed from a flexible material, a bottom face of the outboard extent having a matrix of tight bundles of bristles coupled thereto and extending therefrom, the bottom face further having a pair of longitudinally disposed parallel columns of linearly aligned apertures formed therein, wherein the inboard extent has a plurality of threaded grooves formed therein for removably coupling with those of the housing;

a valve mechanism including a pair of longitudinally disposed resilient tabs integrally coupled within an interior space of the outboard extent of the brush assembly between a front and a rear face thereof, each tab having a post coupled thereto and extending laterally for coupling with an interior surface of a side face of the outboard extent of the brush assembly, wherein the tabs have an unbiased orientation situated over an associated one of the columns of apertures of the brush assembly for precluding a flow of toothpaste therethrough and a biased orientation upon the depression of the side faces of the outboard extent of the brush assembly for exposing the corresponding apertures of the brush assembly thus allowing toothpaste to be dispensed therethrough; and a cover constructed from a transparent plastic material and including a circular top face and a cylindrical peripheral side wall integrally coupled to the top face and extending therefrom to define an open bottom for releasably receiving the top portion of the housing thereby selectively covering the brush assembly.

2. A toothpaste dispensing toothbrush comprising:

a housing for storing toothpaste therein;

a hollow brush assembly coupled to the housing and including bristles extending therefrom and at least one opening formed therein which is in communication with the housing; and a flexible tab constructed from a resilient, deformable plastic material mounted within the brush assembly with a first unbiased orientation for closing the at least one opening of the brush assembly and a second biased orientation for allowing toothpaste to be expelled through the at least one opening;

wherein a gripping button is coupled to the flexible tab and extends from the brush assembly for urging the flexible tab into the second biased orientation;

wherein the gripping button extends from a side face of the brush assembly which remains in parallel with the bristles of the brush assembly.

3. A toothpaste dispensing toothbrush as set forth in claim 2 wherein the brush assembly is removably coupled to the housing.

4. A toothpaste dispensing toothbrush as set forth in claim 2 wherein a transparent cap is removably coupled over the brush assembly.

5. A toothpaste dispensing toothbrush as set forth in claim 2 wherein the at least one opening includes a jagged groove.

6. A toothpaste dispensing toothbrush as set forth in claim 2 wherein the at least one opening includes at least one short lateral slit.

7. A toothpaste dispensing toothbrush as set forth in claim 2 wherein the at least one opening includes at least one elongated longitudinal slot.

8. A toothpaste dispensing toothbrush as set forth in claim 2 wherein the at least one opening includes a pair of columns of linearly aligned apertures.

9. A toothpaste dispensing toothbrush as set forth in claim 2 wherein a pair of flexible tabs are mounted within the brush assembly.

10. A toothpaste dispensing toothbrush as set forth in claim 2 wherein the brush assembly includes a recess for accepting the gripping button.

11. A toothpaste dispensing toothbrush comprising:

a housing for storing toothpaste therein;

a hollow brush assembly coupled to the housing and including bristles extending therefrom and at least one opening formed therein which is in communication with the housing;

valve means mounted on the brush assembly for selectively allowing the passage of the toothpaste through the at least one opening; and a cap including a pair of open ends having threaded grooves formed in an interior surface thereof and a divider formed in a central extent of the cap with a planar first side face and a sharp second side face, whereby the cap is coupleable on the housing in a first orientation for storage purposes and in a second orientation for piercing a membrane situated thereon.

12. A toothpaste dispensing toothbrush as set forth in claim 11 wherein the valve means is adapted for selectively allowing the passage of the toothpaste through the at least one opening only upon the depression of the brush assembly.

13. A toothpaste dispensing toothbrush as set forth in claim 11 wherein the valve means includes at least one flexible tab mounted over the opening.

14. A toothpaste dispensing toothbrush as set forth in claim 13 wherein the tab is connected to a side face of the brush assembly.

15. A toothpaste dispensing toothbrush as set forth in claim 11 wherein the brush assembly is constructed from a resilient, deformable plastic material.

16. A toothpaste dispensing toothbrush as set forth in claim 11 wherein the at least one opening includes a jagged groove.

17. A toothpaste dispensing toothbrush as set forth in claim 11 wherein the at least one opening includes at least one short lateral slit.

18. A toothpaste dispensing toothbrush as set forth in claim 11 wherein the at least one opening includes at least one elongated longitudinal slot.

19. A toothpaste dispensing toothbrush as set forth in claim 11 wherein the at least one opening includes a pair of columns of linearly aligned apertures.

* * * * *